US006594964B2

(12) United States Patent
Charland

(10) Patent No.: US 6,594,964 B2
(45) Date of Patent: Jul. 22, 2003

(54) GROOVED CONSTRUCTION BEAM

(76) Inventor: Gilles Charland, 26, Michel, St-Chrysostome, Quebec (CA), J0S 1R0

( * ) Notice: Subject to any disclaimer, the term of this patent is extended or adjusted under 35 U.S.C. 154(b) by 58 days.

(21) Appl. No.: 09/929,078

(22) Filed: Aug. 15, 2001

(65) Prior Publication Data

US 2002/0026762 A1 Mar. 7, 2002

(30) Foreign Application Priority Data

Aug. 15, 2000 (GB) ..... 0019934

(51) Int. Cl.[7] ..... E04B 1/70; E04C 3/00

(52) U.S. Cl. ..... 52/302.1; 52/302.3; 52/309.13; 52/480; 52/481.1; 52/745.19

(58) Field of Search ..... 52/730.7, 733.2, 52/309.13, 302.1, 302.3, 480, 481.1, 481.2, 745.19, 740.5, 793.11; 144/368, 371, 379; 34/94

(56) References Cited

U.S. PATENT DOCUMENTS 1,163,034 A * 12/1915 Phippen ..... 52/302.1 X
2,118,237 A * 5/1938 Slayter et al. ..... 52/481.1
2,643,539 A * 6/1953 Bouch ..... 52/302.3
2,862,255 A * 12/1958 Nelson ..... 52/480 X
3,127,704 A * 4/1964 Garcia ..... 52/481.1 X
4,031,681 A * 6/1977 Charniga ..... 52/408
4,235,057 A * 11/1980 Teeters ..... 52/733.2 X
4,393,633 A * 7/1983 Charniga ..... 52/302.3
5,471,807 A * 12/1995 Vasquez ..... 52/553
5,477,651 A * 12/1995 Fitzgibbon ..... 52/302.1
5,813,137 A * 9/1998 Townsend ..... 34/518
6,134,803 A * 10/2000 Gilchrist et al. ..... 34/94
6,427,413 B1 * 8/2002 Lafrance ..... 52/481.1 X

* cited by examiner

*Primary Examiner*—Laura A. Callo

(57) ABSTRACT

A construction beam defining a pair of lateral surfaces and a pair of abutment surfaces. The beam defines a set of alternating grooves and intermediate segments extending between the grooves. When the abutment surfaces are abuttingly positioned against other surfaces, the grooves being filled with air provide vibration dampening and thus reduced noise transmission. The air-filled grooves also provide thermal insulation. The configuration of the grooves allows trough flow of air reducing the risks of trapping moisture that could lead to rotting. The intermediate segments are optionally made of resilient material.

14 Claims, 2 Drawing Sheets

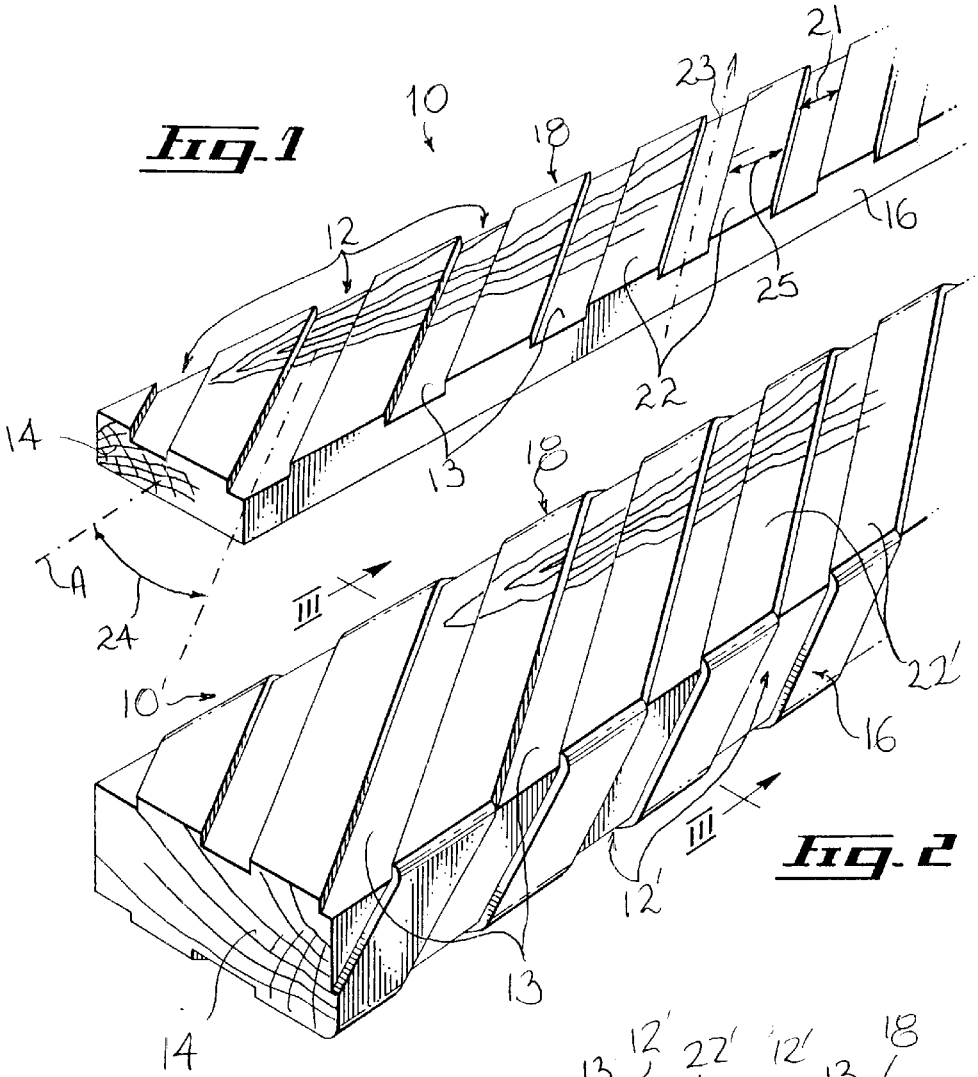
Fig. 1
Fig. 2
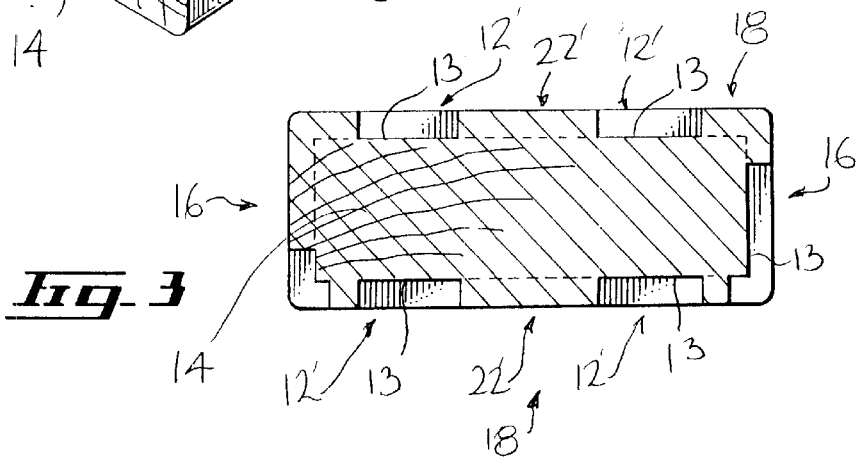
Fig. 3

Fig. 4
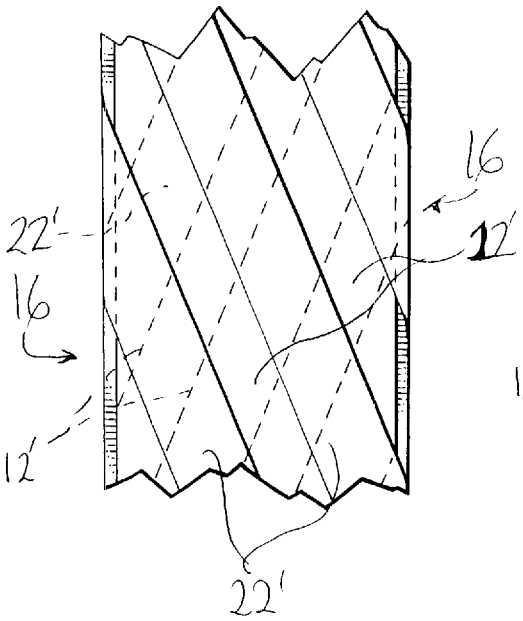
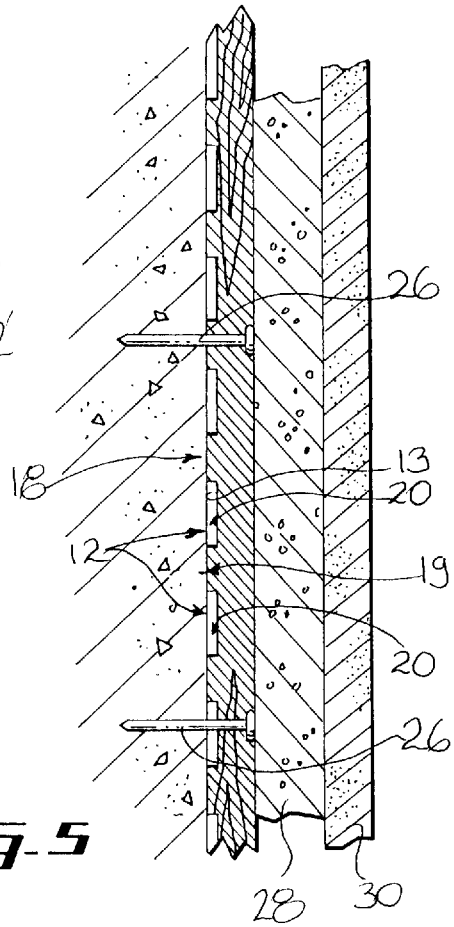
Fig. 5
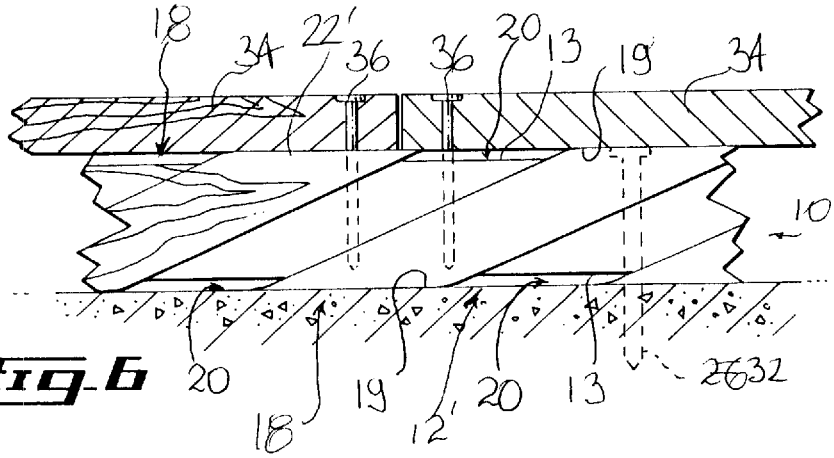
Fig. 6

GROOVED CONSTRUCTION BEAM

FIELD OF THE INVENTION

The present invention relates to the field of construction material and is particularly concerned with a grooved construction beam.

BACKGROUND OF THE INVENTION

Beams made of material such as wood are conventionally used in the construction of building frames. The beams are used for a variety of purposes such as for acting as studs, joists, braces, posts and the like. Although efficiently serving their intended purpose, the prior art beams nevertheless suffer from a set of drawbacks.

For example, being made of an integral piece of material with flat abutment surfaces, prior art beams have a tendency to transmit vibration and, hence, to transmit noises from one room to the other. Typically, the vibrations imparted on a floor joist in a room located in a first end of the building are directly transmitted to a room located at the opposite end of the building through the continuous and flat abutment surfaces of the prior art beams. The vibration is, in turn, converted into noise by adjacent vibrating components.

Another drawback associated with conventional beams used in the construction of building frames is that their flat abutment surfaces do not allow for ventilation between the beam and adjacent abutting structures. For example, both the surface of the floor joist in abutting contact with the corresponding sub-floor and the surface of the wall stud in abutting contact with the sheathing simply do not allow for air circulation and, hence, the overall heat transfer characteristics of the building may suffer. Furthermore, accumulation of trapped humidity may lead to rotting or other types of deterioration of the frame structure over an extended period of time.

The problems associated with prior art construction beams has been recognized in the prior art. For example, U.S. Pat. No. 3,605,360 discloses a pre-stressed vertically laminated beam of wood, which beam comprises inner metal laminated members and outer wood laminated members. These metal and wooden members are fastened together by nails, screws and the like. The document also discloses a complicated manner by which to secure the components of the composite beam, which beam may consist of relatively heavy material. The composite material may prove to be efficient against transmission of vibration but it inherently increases manufacturing costs and renders the overall structure relatively heavy.

Accordingly, there exists a need for an improved beam specifically well adapted for use in building frames. Hence, it is an object of the present invention to provide an improved beam structure.

Advantages of the present invention include that the proposed grooved construction beam reduces the transmission of vibrations and of noise to adjacent structures.

Also, the proposed construction beam allows for venting between the beam and abutting structure to which it is attached. The proposed beam thus reduces the risks of moisture accumulation with consequent potential rotting of the building frame.

Furthermore, by providing pockets of air between the beam and the structure to which it is attached, the proposed beam improves the overall thermal insulation characteristics of the building frame.

Still further, the proposed construction beam is adapted to conform to conventional forms of manufacturing, so as to be of simple construction and easy to use, thus providing a construction beam that will be economically feasible, long lasting and relatively trouble free in operation.

The present invention also relates to a method of manufacturing a beam in accordance with the invention through a set of easy, efficient and relatively inexpensive steps so as to allow manufacturing of the proposed beam at low costs.

In accordance with the present invention, there is provided a construction beam for use adjacent a frame abutment surface, the construction beam comprising: a generally elongated body defining a beam longitudinal axis, a pair of longitudinally opposed beam end surfaces, a pair of transversally opposed beam lateral surfaces and a pair of opposed beam abutment surfaces; at least one groove extending substantially transversally across at least one of the beam abutment surfaces; the at least one groove defining a groove base segment, the at least one groove being configured, sized and positioned so that when the beam abutment surface containing the at least one groove is abuttingly positioned against the frame abutment surface, the at least one groove with the frame abutment surface together delimit a channel; whereby the channel is adapted to be filled with a gas, allowing the gas contained within the channel to act as a thermal insulation and vibration-damping component.

Preferably, the at least one groove extends at an angle relative to the beam longitudinal axis. Conveniently, the at least one groove defines a groove with and a groove depth, the at least one groove having a groove depth to groove width ration substantially in the range of ⅙. Preferably, each groove defines a corresponding groove width between the peripheral edges of adjacent intermediate segments and each intermediate segment defines an intermediate segment width between the peripheral edges of adjacent grooves; the ratio of groove width to intermediate segment width defining a value substantially in the range of 0.6.

In accordance with one embodiment of the invention, the intermediate segment is made of a first material and the rest of the construction beam is made of a second and different material. Conveniently, the first material has inherent vibration damping properties. Preferably, the first material is an elastomeric resin.

In accordance with one embodiment of the invention, the construction beam is provided with a plurality of beam grooves extending substantially transversally across at least one of the beam abutment surfaces, the beam also defining a set of intermediate segments between adjacent beam grooves the intermediate segments extending from a level substantially in register with the groove base segments to a position substantially in register with the at least one beam abutment surface.

In accordance with another embodiment of the invention, the construction beam is provided with a plurality of beam grooves extending substantially transversally across both beam abutment surfaces, the beam also defining a set of intermediate segments between adjacent beam grooves the intermediate segments extending from a level substantially in register with the groove base segments to a position substantially in register with a corresponding beam abutment surface.

In accordance with one embodiment of the invention, the beam grooves are joined in a substantially continuous end-to-end relationship relative to each other so as to form a substantially helicoidally-shaped groove winding substantially continuously across the beam lateral and abutment surfaces, the intermediate segments being joined in a substantially continuous end-to-end relationship relative to each other so as to form a substantially helicoidally-shaped intermediate segment winding substantially continuously across the beam lateral and abutment surfaces.

In accordance with the present invention, there is also provided in combination with a construction panel defining a frame abutment surface, a construction beam attached to the construction panel for linking the construction panel to another frame component, the construction beam comprising: a generally elongated body defining a beam longitudinal axis, a pair of longitudinally opposed beam end surfaces, a pair of transversally opposed beam lateral surfaces and a pair of opposed beam abutment surfaces; at least one groove extending substantially transversally across at least one of the beam abutment surfaces; the at least one groove defining a groove base segment, the at least one groove being configured, sized and positioned so that when the beam abutment surface containing the at least one groove is abuttingly positioned against the frame abutment surface, the at least one groove with the frame abutment surface together delimit a channel; whereby the channel is adapted to be filled with a gas, allowing the gas contained within the channel to act as a thermal insulation and vibration-damping component.

In accordance with the present invention, there is also provided a method for manufacturing a construction beam, the construction beam including a generally elongated body defining a beam longitudinal axis, a pair of longitudinally opposed beam end surfaces, a pair of transversally opposed beam lateral surfaces and a pair of opposed beam abutment surfaces the method comprising the step of: attaching a pair of intermediate segments to one of the beam abutment surfaces, the intermediate segments being attached in a predetermined spaced relationship relative to each other so as to define a groove therebetween, the intermediate segments each defining an intermediate segment height corresponding substantially to the depth of the groove. Preferably, the intermediate segments are adhesively secured to the abutment surface.

BRIEF DESCRIPTION OF THE DRAWINGS

Embodiments of the present invention will now be described, by way of example, in reference to the following drawings in which:

FIG. 1: in a perspective view with sections taken out, illustrates a construction beam in accordance with a first embodiment of the present invention;

FIG. 2: in a perspective view with sections taken out, illustrates a construction beam in accordance with a second embodiment of the present invention;

FIG. 3: in a cross sectional view taken along arrows III—III of FIG. 2, illustrates a transversal section of the beam shown in FIG. 2;

FIG. 4: in an elevational view with sections taken out, illustrates part of a beam in accordance with the second embodiment of the present invention;

FIG. 5: in a cross sectional view with sections taken out, illustrates a beam in accordance with a first embodiment of the present invention being used as part of the frame of a partition wall;

FIG. 6: in a cross sectional view with sections taken out, illustrates a beam in accordance with a second embodiment of the present invention being used as a floor joist.

DETAILED DESCRIPTION OF THE DRAWINGS

Referring to FIG. 1, there is shown a beam 10 in accordance with an embodiment of the present invention. The beam 10 has a generally elongated configuration defining a beam longitudinal axis "A". It should be understood that the beam 10 could have any other suitable configuration without departing from the scope of the present invention as long as it includes a set of grooves 12 formed thereon.

Typically, the beam 10 defines a pair of longitudinally opposed beam end surfaces 14, a pair of transversally opposed beam lateral surfaces 16, and a pair of opposed beam abutment surfaces 18 (only one of each being shown in FIG. 1). The beam 10 includes at least one and preferably a set of grooves 12 formed on at least one of its abutment surfaces 18. In the embodiment illustrated in FIG. 1, only one of the beam abutment surfaces 18 is provided with grooves 12.

Each groove 12 defines a corresponding groove base segment 13. Although the groove base segments 13 are shown throughout the figures as having a generally flat configuration, it should be understood that the groove base segments 13 could have other configurations without departing from the scope of the invention. As illustrated in FIGS. 5 and 6, the grooves 12 are configured, sized and positioned so that when a beam abutment surface 18 containing at least one groove 12 is abuttingly positioned against a frame abutment surface 19, at least one and preferably all grooves 18 cooperate with the frame abutment surface 19 so as to delimit corresponding channels 20 therebetween. The channels 20 are adapted to be filled with a gas, allowing the gas contained within the channel to act as a thermal insulating and vibration damping means. The channels 20 preferably allow flow of air therethrough as indicated by arrow 23 in FIG. 1.

Typically, the grooves 12 extend substantially transversally across the beam 10 from one lateral surface 16 to the other. The grooves 12 are typically angled relative to the longitudinal axis "A" of the beam 10. A typical angle referred to by the reference numeral 24 in FIG. 1 is illustrated by way of example. It should be understood that, alternatively, the grooves 12 may extend only partially across the abutment surfaces 18 or in an intermittent fashion across the beam 10 without departing from the scope of the present invention. Also, the grooves 12 may extend in directions other than those illustrated in the drawings and form different types of patterns without departing from the scope of the present invention.

When more then one groove 12 extends across an abutment surface 18, a so-called intermediate segment 22 is defined between adjacent grooves 12. Each intermediate segment 22 has an intermediate segment height extending from a level substantially in register with the groove base segment 13 to a level substantially in register with the beam abutment surface 18. Typically, the intermediate segment height corresponds to the groove depth. Also, each groove 12 defines a corresponding groove width 21 between the peripheral edges of adjacent intermediate segments 22. Similarly, each intermediate segment 22 defines an intermediate segment width 25 between the peripheral edges of adjacent grooves 12.

Preferably, the ratio between groove width 21 and intermediate segment width 25 in a given region of the beam 10 is predetermined so as to offer a compromise between providing channels 20 of sufficient size for venting and insulating while maintaining the overall structural rigidity of the beam 10. In other words, the intermediate segments 22 defined between the grooves 12 must remain of a sufficient size to provide the beam 10 with sufficient structural rigidity while allowing a sufficiently large volume of air to be contained in the ventilating channels 20 in order to provide the venting and insulating advantages.

Typically, the ratio of groove width 21 to intermediate segment width 25 defines a value substantially in the range of 0.6. Also typically, the grooves 12 are sized so as to define a groove depth to groove width ratio substantially in the range of ⅙. The hereinabove mentioned ratios allow for the use of the relatively soft woods conventionally used for building frames while providing the interesting characteristics associated with the invention.

FIGS. 2 through 4 illustrate a second embodiment of the invention wherein the beam 10' is provided with grooves 12' that extend in a helicoidally continuous pattern across the lateral and abutment surfaces 16 and 18. The beam grooves 12' are joined in a substantially continuous end-to-end relationship relative to each other so as to form a substantially helicoidally shaped continuous groove winding substantially continuously across the beam lateral and abutment surfaces 16 and 18. Similarly, the intermediate segments 22' are joined in a substantially continuous end-to-end relationship relative to each other so as to form a substantially helicoidally shaped continuous intermediate segment 22' winding substantially continuously across the beam lateral and abutment surfaces 16 and 18. Again, it should be understood that other pattern configurations such as a "zig-zag" type or any other suitable type of groove configuration could be used without departing from the scope of the present invention.

In an alternative embodiment of the invention, the intermediate segments 22 are made of a first material and the rest of said construction beam 10 is made of a second and different material. Typically, the first material has inherent vibration damping properties. For example, the first material may be an elastomeric resin or other suitable material. The use of an elastomeric or other resilient material could further enhance the vibration dampening characteristics of the beams 10 and 10'.

The grooves 12 and 12' may be formed using any suitable manufacturing process. For example, they may be grinded or otherwise machined directly into the beam 10 or 10'. In an alternative manufacturing method, the grooves 12 and 12' may be formed by attaching flat surfaces strips of material (not shown) that define the intermediate segments 22 on the abutment surfaces 18. The strips of material may be mounted on the beams 10 using any suitable method such as an adhesive means, a fastening component, a tongue and groove system or the like.

FIG. 5 illustrates a beam 10 in accordance with the first embodiment of the invention, being used as part of a wall assembly. The beam 10 is shown mounted to a supporting structure 19 using conventional fastening means such as nails 26. Insulating material 28 and a finishing panel 30 are mounted to the beam 10 in a conventional manner.

FIG. 6 illustrates a beam 10' in accordance with the second embodiment of the invention, being used as part of a floor assembly. The beam 10' is shown mounted on a supporting structure 19 using conventional fastening means such a nail 32. A pair of floor panels 34 are shown mounted on the beam 10' using nails 36.

FIGS. 5 and 6 illustrate two typical applications for the present invention and it should be understood that other similar applications may be made without departing from the scope of the present invention.

Regardless of the applications, the grooves 12 not only form channels 20 allowing through flow of air so as to reduce the risks of trapping air with consequent rotting. The channels 20 being filled with air define air pockets that are adapted to dampen the vibrations transmitted by the beams 10, 10' and, hence, reduce the level of noise transmitted by the beams 10 and 10'. The air pockets are further adapted to provide thermal insulation.

The embodiments of the invention in which an exclusive privilege or property is claimed are defined as follows:

1. A construction beam for use adjacent a frame abutment surface, said construction beam comprising:

a generally elongated body defining a beam longitudinal axis, a pair of longitudinally opposed beam end surfaces, a pair of transversally opposed beam lateral surfaces and a pair of opposed beam abutment surfaces; at least one groove extending substantially transversally across at least one of said beam abutment surfaces; said at least one groove defining a groove base segment, said at least one groove being configured, sized and positioned so that when the beam abutment surface containing said at least one groove is abuttingly positioned against said frame abutment surface, said at least one groove with said frame abutment surface together delimit a channel; whereby said channel is adapted to be filled with a gas, allowing said gas contained within said channel to act as a thermal insulation and vibration-damping component; said at least one groove extending at an angle relative to said beam longitudinal axis; said at least one groove defining a groove with and a groove depth, said at least one groove having a groove depth to groove width ration substantially in the range of ⅙.

2. A construction beam as recited in claim 1 wherein said construction beam is provided with a pair of beam grooves extending substantially transversally across at least one of said beam abutment surfaces, said pair of beam grooves defining an intermediate segment extending therebetween, said intermediate segment extending from a level substantially in register with said groove base segment to a position substantially in register with said at least one beam abutment surface; each groove defining a corresponding groove width between the peripheral edges of adjacent intermediate segments and each intermediate segment defines an intermediate segment width between the peripheral edges of adjacent grooves; the ratio of groove width to intermediate segment width defining a value substantially in the range of 0.6.

3. A construction beam as recited in claim 2 wherein said intermediate segment is made of a first material and the rest of said construction beam is made of a second and different material.

4. A construction beam as recited in claim 3 wherein said first material has inherent vibration damping properties.

5. A construction beam as recited in claim 4 wherein said first material is an elastomeric resin.

6. A construction beam as recited in claim 1 wherein said construction beam is provided with a plurality of beam grooves extending substantially transversally across at least one of said beam abutment surfaces, said beam also defining a set of intermediate segments between adjacent beam grooves said intermediate segments extending from a level substantially in register with said groove base segments to a position substantially in register with said at least one beam abutment surface.

7. A construction beam as recited in claim 1 wherein said construction beam is provided with a plurality of beam grooves extending substantially transversally across both beam abutment surfaces, said beam also defining a set of intermediate segments between adjacent beam grooves said intermediate segments extending from a level substantially in register with said groove base segments to a position substantially in register with a corresponding beam abutment surface.

8. A construction beam as recited in claim 7 wherein said beam grooves are joined in a substantially continuous end-to-end relationship relative to each other so as to form a substantially helicoidally-shaped groove winding substantially continuously across the beam lateral and abutment surfaces, said intermediate segments being joined in a substantially continuous end-to-end relationship relative to each other so as to form a substantially helicoidally-shaped intermediate segment winding substantially continuously across the beam lateral and abutment surfaces.

9. In combination with a construction panel defining a frame abutment surface, a construction beam attached to said construction panel for linking said construction panel to another frame component, said construction beam comprising:

a generally elongated body defining a beam longitudinal axis, a pair of longitudinally opposed beam end surfaces, a pair of transversally opposed beam lateral surfaces and a pair of opposed beam abutment surfaces; at least one groove extending substantially transversally across at least one of said beam abutment surfaces; said at least one groove defining a groove base segment, said at least one groove being configured, sized and positioned so that when the beam abutment surface containing said at least one groove is abuttingly positioned against said frame abutment surface, said at least one groove with said frame abutment surface together delimit a channel; whereby said channel is adapted to be filled with a gas, allowing said gas contained within said channel to act as a thermal insulation and vibration-damping component; said construction beam being provided with a plurality of beam grooves extending substantially transversally across at least one of said beam abutment surfaces, said construction beam also defining a set of intermediate segments between adjacent beam grooves said intermediate segments extending from a level substantially in register with said groove base segments to a position substantially in register with said at least one beam abutment surface; said construction beam being provided with a plurality of beam grooves extending substantially transversally across both beam abutment surfaces, said beam also defining a set of intermediate segments between adjacent beam grooves said intermediate segments extending from a level substantially in register with said groove base segments to a position substantially in register with a corresponding beam abutment surface.

10. A construction beam as recited in claim 9 wherein said beam grooves are joined in a substantially continuous end-to-end relationship relative to each other so as to form a substantially helicoidally-shaped groove winding substantially continuously across the beam lateral and abutment surfaces, said intermediate segments being joined in a substantially continuous end-to-end relationship relative to each other so as to form a substantially helicoidally-shaped intermediate winding substantially continuously across the beam lateral and abutment surfaces.

11. A construction beam as recited in claim 9 wherein said construction beam is made of a first material and said intermediate segment intermediate segment is made of a second material different from said first material.

12. A construction beam as recited in claim 9 wherein said intermediate segments are made out of an elastomeric resin.

13. A method for manufacturing a construction beam, said construction beam including a generally elongated body defining a beam longitudinal axis, a pair of longitudinally opposed beam end surfaces, a pair of transversally opposed beam lateral surfaces and a pair of opposed beam abutment surfaces said method comprising the step of:

attaching a pair of intermediate segments to one of said beam abutment surfaces, said intermediate segments being attached in a predetermined spaced relationship relative to each other so as to define a groove therebetween, said intermediate segments each defining an intermediate segment height corresponding substantially to the depth of said groove; a set of intermediate segments being attached to one of said beam abutment surfaces, said intermediate segments being attached in a predetermined spaced relationship relative to each other so as to define a generally helicoidally continuous intermediate segment helicoidally winding around said construction beam.

14. A method for manufacturing a construction beam as recited in claim 13 wherein said intermediate segments are adhesively secured to said abutment surface.

* * * * *